US005805131A

United States Patent [19]

Hartmann et al.

[11] Patent Number: 5,805,131

[45] Date of Patent: Sep. 8, 1998

[54] FERROELECTRIC DISPLAY DEVICE WITH TEMPERATURE COMPENSATION

[75] Inventors: Wilbert J. A. M. Hartmann, Eindhoven; Franciscus H. A. Lathouwers, Dommelen, both of Netherlands

[73] Assignee: U.S. Philips Corporation, New York, N.Y.

[21] Appl. No.: 727,831

[22] Filed: Oct. 2, 1996

Related U.S. Application Data

[63] Continuation of Ser. No. 301,445, Sep. 6, 1994, abandoned.

[30] Foreign Application Priority Data

Sep. 7, 1993 [BE] Belgium ..... 09300917

[51] Int. Cl.[6] ..... G09G 3/36

[52] U.S. Cl. ..... 345/101; 345/97; 349/72

[58] Field of Search ..... 345/97, 87, 101, 345/89, 98, 204, 207; 359/56, 73; 349/72

[56] References Cited

U.S. PATENT DOCUMENTS 3,907,405 9/1975 Fukai et al. ..... 345/101
5,047,758 9/1991 Hartmann et al. ..... 340/784

FOREIGN PATENT DOCUMENTS 0002920 1/1982 European Pat. Off. .
0554066 8/1993 European Pat. Off. .

*Primary Examiner*—Regina D. Liang
*Attorney, Agent, or Firm*—David R. Treacy

[57] ABSTRACT

To compensate for the variation of the transmission-voltage characteristic curve due to temperature changes in a ferroelectric display device, the display device is provided with one or more measuring elements (5) for measuring the polarization current. The drive voltages are corrected by means of the polarization current which is used as a feedback parameter.

7 Claims, 2 Drawing Sheets

FERROELECTRIC DISPLAY DEVICE WITH TEMPERATURE COMPENSATION

This is a continuation of application Ser. No. 301,445, filed Sep. 6, 1994, now abandoned.

BACKGROUND OF THE INVENTION

The invention relates to a display device comprising a ferro-electric electro-optical medium between two supporting plates, a first supporting plate of which comprises one or more selection electrodes for presenting a selection voltage and a second supporting plate comprises one or more electrodes which, together with electrodes on the first supporting plate and the electro-optical medium therebetween, define pixels.

Display devices of this type are used in, for example display apparatuses for (personal) computers and for video applications.

A display device of the type described above, in which a ferro-electric liquid crystal is used as a display medium, described in U.S. Pat. No. 5,047,758 (PHN 12.352), in which also a suitable drive mode is used.

A problem of using this type of display devices is the temperature dependence of the transmission-voltage characteristic (the relation between the voltage applied across a pixel and the associated optical transmission) of the pixels in such a display device. Said temperature dependence appears to depend also on the preprocessing operations to which these types of display devices are subjected (the "temperature history").

In the completed state, when the effects of this temperature history (for example, each time after switch-on) have been eliminated as much as possible, a shift of the transmission-voltage characteristic may also occur.

Such shifts may be approximately 100–2000 mV at one given temperature, dependent on the temperature history of the display device.

Since it must be possible to adjust a large number of grey scale stages (approximately 100) over a total width of this characteristic which may be of the order of 4 V, even after said preprocessing treatments have been performed, a shift of 40 mV corresponds to approximately one grey scale stage.

Consequently, display devices of this type are not readily suitable for displaying grey levels.

Display devices which switch only between two extreme states (for example, black-white) may lose contrast due to this variation of the transmission-voltage characteristic curve.

OBJECTS AND SUMMARY OF THE INVENTION

It is an object of the present invention to provide a display device of the type described in the opening paragraph in which the adjustment is insensitive or not very sensitive to temperatures.

Such a display device is characterized in that it is provided, at the area of the electro-optical medium, with measuring electrodes arranged opposite each other on the first and second supporting plates and with a measuring device for measuring a polarization current between the measuring electrodes, and a compensation device for compensating, dependent on the measured polarization current, the selection voltage or a voltage for the electrode on the second supporting plate.

The invention is based on the recognition that the value of the polarization current within an element defined by electrodes depends on the applied voltage in substantially the same manner as the transmission. In addition, this polarization current within the display device can be measured in a much simpler way than the transmission; for the latter measurement very complicated equipment is often required, for example stable photosensitive elements and temperature-independent light sources.

In a device according to the invention grey levels can be realised in such a way that the adjustment of these grey levels is insensitive or not very sensitive to temperatures.

To avoid the visibility of the extra elements for temperature compensation as much as possible, the measuring electrodes are preferably arranged outside the area of the pixels. These measuring electrodes may be implemented as narrow metal electrodes.

A preferred embodiment of a display device according to the invention is characterized in that the compensation device is adapted in such a way that the polarization current is 50% (or another predetermined value) of the maximum polarization current between the measuring electrodes when the compensated selection voltage is presented to one of the measuring electrodes at a voltage of 0 V at the associated other measuring electrode.

In such a device the drive mode as described in U.S. Pat. No. 5,047,758 (PHN 12.352) can be used advantageously because the range of data voltages to be presented can then be chosen to be symmetrically around 0 V so that a simple correction of the selection voltage is sufficient. Other drive modes are alternatively possible, in which, for example, the data voltage is corrected.

The electronic equipment for measuring the polarization current is relatively simple in this case because it is necessary to measure at only one point of the polarization current-voltage characteristic curve. For a more accurate correction the polarization current can be measured, if desired, at a plurality of points of the polarization current-voltage characteristic curve (for example, at 25% and 75% of the maximum polarization current and, if necessary, at other points), and the selection voltage (or the voltage at the electrode on the second supporting plate) can be subsequently adapted.

The polarization current is determined, for example in that the peak current is measured during presentation of the selection voltage or in that a current-time integral is determined. If necessary, there is a compensation for fixed parasitic currents which are present due to, for example capacitive effects and resistive effects which may occur in the device but are independent of the position of the transmission-voltage characteristic curve.

BRIEF DESCRIPTION OF THE DRAWINGS

These and other aspects of the invention will be apparent from and elucidated with reference to the embodiments described hereinafter.

In the drawings

FIG. 2 is a diagrammatic plan view of such a device which, according to the invention, is provided with measuring points for determining the polarization current, while

DESCRIPTION OF THE PREFERRED EMBODIMENTS

Figure 1:
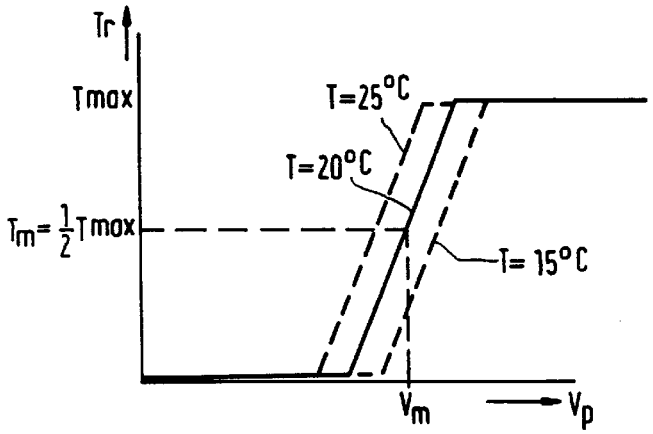
FIG. 1 shows diagrammatically the transmission-voltage characteristic curve of a display device based on a ferro-electric medium.

FIG. 1 shows some transmission-voltage characteristic curves of a pixel with an electro-optical display medium based on a ferro-electrical effect, in this case a ferro-electric liquid crystal. As is apparent from the Figure, this characteristic curve may shift considerably with the temperature. For example, the characteristic curves show a shift of approximately 5 V between 15° C. and 25° C. Moreover, practice has proved that a given shift may occur also at a fixed temperature, dependent on the history of the display device.

Figure 2:
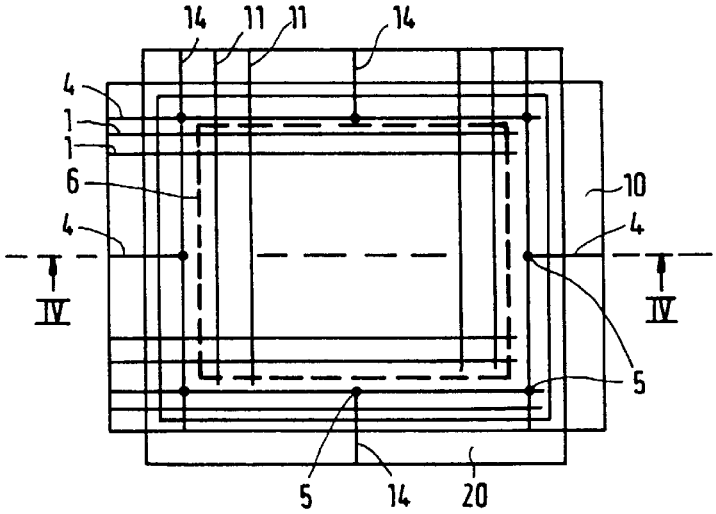

FIG. 2 is a diagrammatic plan view of a part of a display device in which the invention is realised. This device is composed of a matrix of pixels 21 which are located at the areas of crossings of row electrodes 1 and column electrodes 11 arranged on the respective substrates (supporting plates) 10, 20 of a ferro-electric liquid crystal display device.

Figure 3A:
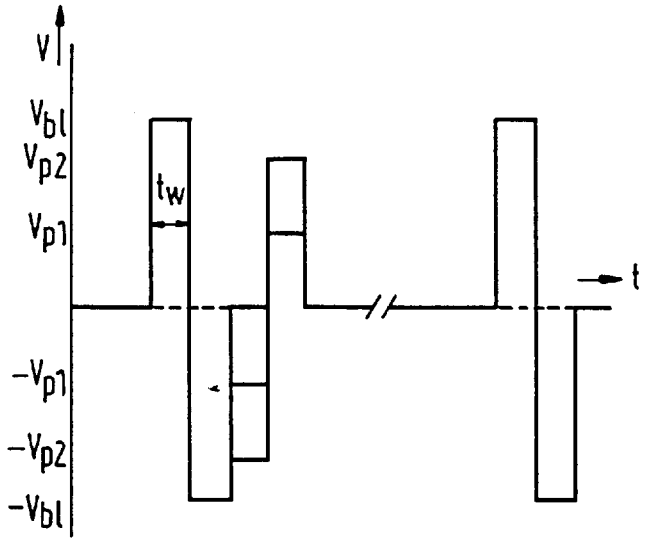
FIG. 3 shows the voltage variation across a pixel for different voltage levels on this pixel (grey levels), as well as the transmission variation and the associated variation of the polarization current
Figure 3B:
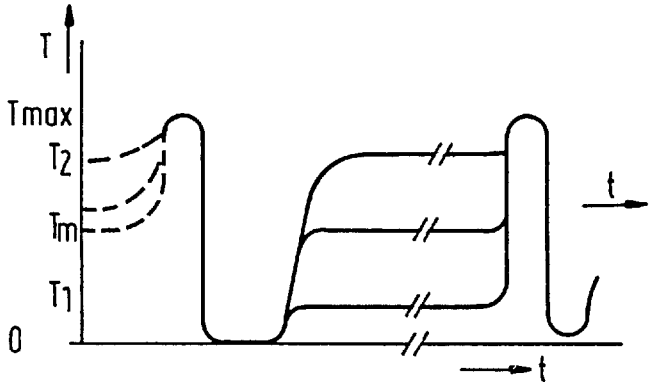
Figure 3C:
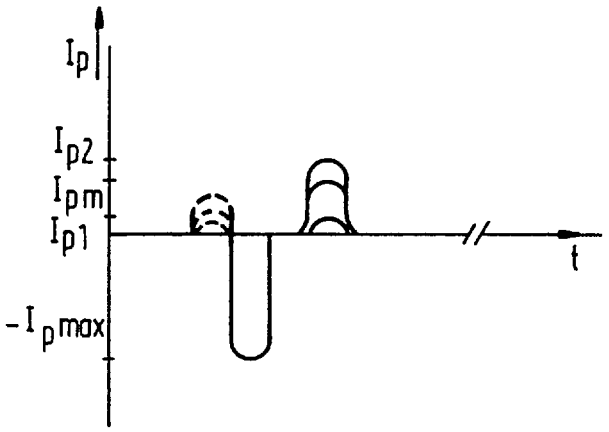

FIG. 3*b* shows a possible voltage variation across such a pixel for different grey levels, if the device is driven by means of a mode as described in U.S. Pat. No. 5,047,758, whose contents are herein incorporated by reference. Before the pixel is provided with a bipolar signal having, for example absolute values of the voltages $V_{p1}$, $V_{pm}$ or $V_{p2}$ which define different grey levels, a "blanking" signal, which is also bipolar is presented with absolute values of the voltages $V_{b1}$. Consequently, the pixel is brought to an extreme (defined) state (FIG. 3*a*). At a fixed pulse width $t_w$ intermediate transmission levels $T_1$, $T_m$, $T_2$ (grey levels) are obtained (FIG. 3*b*) at different values of the voltages $V_{p1}$, $V_{pm}$, $V_{p2}$. These grey levels are obtained in that, under the influence of the applied voltage, dipoles associated with the ferro-electric liquid crystal molecules flip over and acquire a different polarization. Consequently, larger or smaller numbers of domains having a different transmission state (for example, light-transmissive in an ambience which is light-absorbing, or vice versa) are formed on a microscopic scale, which domains define the macroscopic transmission level, i.e. the grey level. The dipole flip-over also defines a polarization current $I_{p1}$, $I_{pm}$, $I_{p2}$ (FIG. 3*c*) which is a measure of the relevant grey level. Since the quantity of dipoles which have flipped over as a percentage of the total number of dipoles is a direct measure of the grey level, the related polarization current as a percentage of the maximum polarization current (flip-over of all dipoles) is also a direct measure of the grey level. This level is only determined by the number of dipoles (molecules) within a pixel; consequently, a change of the polarization current at the same drive voltage is an indication of a shift of the transmission-voltage characteristic curve due to a temperature change or ageing. The polarization current during the "blanking" signal is dependent on the previous state of the pixel during the first of the two sub-signals (in this case the positive pulse). During the second sub-signal all dipoles flip over and the polarization current is equal to the maximum polarization current ($I_{pmax}$). Parasitic currents due to the above-mentioned capacitive and resistive effects are not shown in FIG. 3*c*. The selection voltage (or another drive voltage) can now be adapted in such a way that the polarization current has the desired (calibration) value again.

For measuring the polarization current in the ferro-electric medium (liquid crystal) between the substrates provided with electrodes, measuring electrodes 4, 14 defining one or more measuring elements 5 (in this example, eight) are also present on the substrate 10, 20, preferably outside the actual display section 6. The measuring electrodes 5 may be formed from the same material as the row electrodes and the column electrodes (for example, indium-tin oxide), but are preferably implemented as metal electrodes so as to prevent effects due to superfluous series resistance as much as possible.

Figure 4:
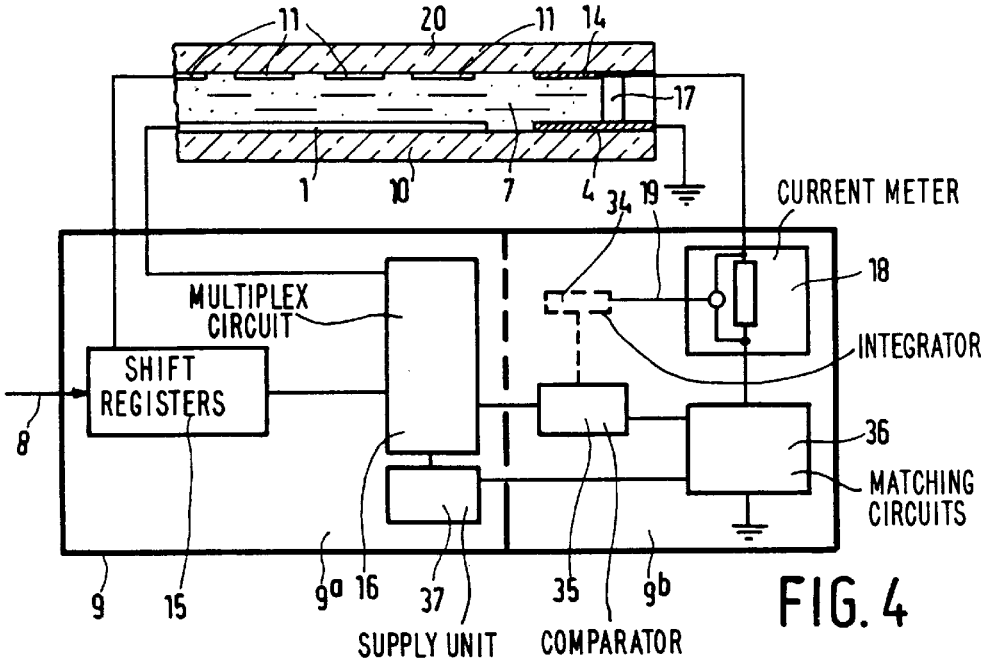
FIG. 4 shows the display device partly in a cross-section taken on the line IV—IV, together with a diagrammatic representation of the drive section incorporating a temperature correction circuit.

FIG. 4 is a cross-section of a display device with substrates 10, 20 provided with row electrodes 1 and column electrodes 11 and a ferro-electric liquid crystalline medium 7 therebetween. A sealing edge 17 is present between the substrates 10, 20.

Pixels are defined at the areas of crossings of row electrodes and column electrodes, in this case by the mutually overlapping parts of these electrodes. The display device is driven in a generally known manner in that a video signal 8 is presented to the processing unit 9. The processing unit has a first part $9^a$ in which incoming information is suitably stored in shift registers 15. With the aid of a multiplex circuit 16 selection voltages (in this example preceded by "blanking" signals) are successively presented to the row or selection electrodes 1 by means of, which are adjustable by for example a supply unit 37, while simultaneously information (data signals) (defining the grey level) is presented via the shift registers. In this case it holds that the absolute value of the difference between the data signal (defined by the video signal 8) and the selection signal defines the grey level. Since the video signal 8 is presented externally, it is advantageous to adapt variations of the transmission-voltage characteristic curve by adapting the selection voltage. To this end, the processing unit 9 of the display device has a second section (or compensation section) $9^b$ which measures the polarization current $I_p$ in one or more of the measuring elements 5 via the measuring electrodes 4, 14, for example, via a current meter 18; the current measured is converted into a signal 19 via a voltage meter. The voltage at the measuring electrode 4 then has a value which is equal to the selection voltage (which is chosen to be equal to $V_m$ (see FIG. 1) at the calibrating temperature, in this example 20° C.) associated with a transmission value $T_m$ of 50% of the maximum transmission $T_{max}$, while the measuring electrode 14 is connected to ground. The polarization current measured in the measuring element 5 is applied via the signal 19 (which may have been processed in an integrator 34) to a comparator 35. If this current is lower than that associated with a voltage difference between selection and data voltages, at which the polarization current is 50% of the maximum polarization current $I_{pmax}$ (which in this case can be measured during the second half of the bipolar "blanking" signal), the selection voltage is adapted via a matching circuit 36 which influences the supply unit 37 of the multiplex circuit 16 in such a way that this difference acquires such a value that the polarization current is 50% of the maximum polarization current. If this current is higher, there will be matching in the other direction. If necessary, this matching may take place in one or more iteration steps.

Instead of a calibration with respect to the 50% value, the polarization-voltage characteristic curve can be compared with the transmission-voltage characteristic curve at a plurality of points, at which the correction values are stored in a processing unit (not shown). In this unit initial corrections, for example for correcting parasitic capacitive and resistive effects can also be processed. The matching circuit 36 then adapts the selection voltage in such a way that the multiplex circuit 16 supplies the correct selection voltages via the supply unit 37. Instead of the selection voltages, the data voltages may also be adapted, if necessary, for shifts of the transmission-voltage characteristic curve due to temperature changes.

Although only eight measuring elements 5 with separate measuring electrodes 4, 14 are shown in the embodiment of FIG. 3, such measuring elements may alternatively be formed by (extra) overlapping row and column electrodes. The pixels need not necessarily be defined by overlapping row and column electrodes; separate picture electrodes may be separated by switching elements of row or column electrodes (active drive). Variations are also possible in determining the polarization current; for example, instead of the current, the current-time integral may alternatively be used as a control parameter.

Instead of liquid crystal materials, other (solid state) ferro-electric electro-optical materials may alternatively be used such as, for example barium titanium oxide, bismuth titanium oxide and zirconium lead titanate.

We claim:

1. A display device having at least one pixel, the pixel having an associated grey-level, the device comprising:

a ferro-electric electro-optical medium, said medium being disposed between a first supporting plate and a second supporting plate, the first supporting plate having at least one selection electrode for presenting a selection voltage and the second supporting plate having at least one data electrode for presenting a data voltage, the pixel being defined by a selection electrode in association with a data electrode, wherein there are at the area of the electro-optical medium;

measuring electrodes, said measuring electrodes being arranged opposite each other on the first and second supporting plates, and being other than the selection and data electrodes;

a measuring device, the measuring device providing for measuring polarization current between the measuring electrodes; and a compensation device, the compensation device providing for compensating, dependent on the polarization current measured by the measuring device, at least one of the selection voltage and the data voltage presented, so as to adjust the grey-level of the pixel, and wherein the compensation device compensates dependent on relationship between the measured polarization current and a reference current value determined as the polarization current associated with switching the pixel from one extreme transmission state to another extreme transmission state.

2. A display device as claimed in claim 1, characterized in that the measuring electrodes are arranged outside the area of the pixels.

3. A display device as claimed in claim 2, characterized in that the electro-optical medium is a liquid crystalline medium.

4. A display device as claimed in claim 2, wherein the compensation device compensates the selection voltage so that the polarization current is 50% of a reference maximum polarization current when the compensated selection voltage is applied to one of the measuring electrodes and when an electrode arranged opposite to said one of the measuring electrodes is at a voltage of 0 V, the reference maximum polarization current being the polarization current associated with switching a pixel from one extreme transmission state to the other extreme transmission state.

5. A display device as claimed in claim 1, characterized in that the electro-optical medium is a liquid crystalline medium.

6. A display device as claimed in claim 1, characterized in that the electro-optical medium is a liquid crystalline medium.

7. A display device as claimed in claim 1, wherein the compensation device compensates the selection voltage so that the polarization current is 50% of a reference maximum polarization current when the compensated selection voltage is applied to one of the measuring electrodes and when an electrode arranged opposite to said one of the measuring electrodes is at a voltage of 0 V, the reference maximum polarization current being the polarization current associated with switching a pixel from one extreme transmission state to the other extreme transmission state.

* * * * *